United States Patent [19]

Aono et al.

[11] Patent Number: 4,713,319

[45] Date of Patent: Dec. 15, 1987

[54] HEAT DEVELOPABLE PHOTOSENSITIVE MATERIAL

[75] Inventors: Toshiaki Aono; Hiroshi Hara, both of Kanagawa, Japan

[73] Assignee: Fuji Photo Film Co., Ltd., Kanagawa, Japan

[21] Appl. No.: 757,983

[22] Filed: Jul. 23, 1985

[30] Foreign Application Priority Data

Jul. 23, 1984 [JP] Japan ..... 59-152497

[51] Int. Cl.[4] ..... G03C 1/02

[52] U.S. Cl. ..... 430/567; 430/203; 430/619

[58] Field of Search ..... 430/617, 619, 611, 613, 430/614, 203, 620, 567

[56] References Cited

U.S. PATENT DOCUMENTS 3,652,279 3/1972 Blake et al. ..... 430/408

4,307,187 12/1981 Ikenoue et al. ..... 430/607

OTHER PUBLICATIONS

European Patent Publication (Konishiroku), EPO 101 194 A2, Feb. 22, 1984, pp. 1–28.

*Primary Examiner*—Won H. Louie

*Attorney, Agent, or Firm*—Sughrue, Mion, Zinn, Macpeak & Seas

[57] ABSTRACT

A heat developable photosensitive material having on a support, a light-sensitive layer containing a light-sensitive silver halide, silver salt grains having a dissolution retarder adsorbed thereto, a reducing agent, and a binder. This material can provide high image density and low fog density and has excellent keeping quality.

11 Claims, No Drawings

HEAT DEVELOPABLE PHOTOSENSITIVE MATERIAL

FIELD OF THE INVENTION

The present invention relates to a heat developable photosensitive material and, more particularly, to a heat developable photosensitive material which has an improved storage quality.

BACKGROUND OF THE INVENTION

Silver halide-based photography is superior in photographic characteristics, e.g., photographic speed, facility of gradient control, etc., to other photographic systems such as electrophotography, diazo photography and so on, and has consequently been most generally used. In recent years, techniques have been developed which enable simple and rapid formation of images by changing the image-forming processing used in the silver halide-based photography from the conventional wet process using a developing solution or the like to a dry process using heat.

Heat developable photosensitive materials are well-known in the photographic art, and such materials and processes for their use are described in, e.g., *Shashin Kogaku no Kiso,* pp. 553–555 (Corona Co., 1979); *Eizo Joho,* p. 40 (April 1978); *Nebletts Handbook of Photography and Reprography,* pp. 32–33, (Van Nostrand Reinhold Company, 7th ed.; U.S. Pat. Nos. 3,152,904, 3,301,678, 3,392,020 and 3,457,075; British Pat. Nos. 1,131,108 and 1,167,777; and *Research Disclosure,* pp. 9–15 (RD-17029) (June 1978).

Many methods for obtaining color images have been proposed. For instance, in the method of forming color images by binding couplers to oxidation products of developing agents, the combination of p-phenylenediamine type reducing agent and phenolic or active methylene-containing couplers is disclosed in U.S. Pat. No. 3,531,286, reducing agents of the p-aminophenol type are disclosed in U.S. Pat. No. 3,761,270, reducing agents of the sulfonamidophenol type are disclosed in Belgian Pat. No. 802,519 and *Research Disclosure,* pp. 31–32 (September 1975), and the combination of sulfonamidophenol type reducing agents with 4-equivalent couplers is disclosed in U.S. Pat. No. 4,021,240.

In addition, the method of forming positive color images using the light-sensitive silver dye bleach process, and useful dyes and bleaching methods are described in, e.g., *Research Disclosure,* pp. 30–32 (RD-14433) (April 1976), *Research Disclosure,* pp. 14–15 (RD-15227)(December 1976), and U.S. Pat. No. 4,235,957.

Moreover, the method of forming images by heat development using compounds containing a dye moiety and which are capable of releasing a mobile dye under high temperature in correspondence or counter-correspondence to the reduction reaction of silver halide to silver, is disclosed in European Published Patent Application Nos. 76,492 and 799,056, and Japanese Patent Application (OPI) Nos. 28928/83 and 26008/83 (the term "OPI", as used herein, refers to a "published unexamined Japanese Patent Application").

In these heat developable photosensitive materials, organic silver salts are usually incorporated as a source of silver ion supply. This is generally required because the materials typically cannot produce images of perceptible density, much less of photographically sufficient density, by heating unless organic silver salts are contained therein.

However, incorporating organic silver salts into heat developable photosensitive materials generally has the following disadvantages:

(1) Raising the heating temperature and prolonging the heating step with the intention of achieving sufficient density causes an increase in minimum density (fog density).

(2) Photosensitive materials in which both spectrally sensitized silver halides and organic silver salt oxidizers are present cause a sharp decrease in sensitivity during storage.

(3) It is difficult to flocculate organic silver salts in the washing step included in an emulsion-making process, because they have low specific gravities.

SUMMARY OF THE INVENTION

An object of the present invention is to overcome the above-described problems which have been caused by incorporation of organic silver salts. More specifically, a first object of the present invention is to provide a heat developable photosensitive material with improved storage qualities. A second object of the present invention is to provide a heat developable photosensitive material having high image density and low fog density. A third object of the present invention is to provide a heat developable photosensitive material which can be efficiently and economically produced.

These and other objects of the present invention are attained with a heat developable photosensitive material comprising a support, having a light-sensitive layer thereon wherein the light-sensitive layer comprises a light-sensitive silver halide, silver salt grains having a dissolution retarder adsorbed thereto, a reducing agent and a binder.

DETAILED DESCRIPTION OF THE INVENTION

It is desirable that the silver salt grains used in the present invention have sensitivity to light equal to or lower than that of the light-sensitive silver halide. Preferably, the sensitivity of the silver salt grains is sufficiently low that when light energy necessary to sensitize the above-described light-sensitive silver halide is applied to the heat developable photosensitive material of the present invention, the silver salt grains remain substantially unsensitized. Specifically, silver salt grains having a sensitivity less than that of light-sensitive silver halide by a factor of at least about 10 are particularly preferred.

In addition, it is desired that these silver salt grains should have greater solubility in water than the foregoing light-sensitive silver halide, when they do not have a dissolution retarder adsorbed thereto.

Although not desiring to be bound by the following theory, it is believed that silver salt grains whose individual surfaces have been rendered slightly water soluble by forming a coat of a dissolution retarder (i.e., a compound which is adsorbed on the surface of the silver salt grains, thereby rendering the silver salt grains slightly soluble in water) thereon can be changed into a water-soluble state when reaction products generated by reducing optically exposed light sensitive silver halide grains with a reducing agent act on a dissolution retarder or the site of the silver salt at which the dissolution retarder is adsorbed and thereby, the adsorbing power is weakened or desorption is caused. It can be also presumed that silver salt grains which have been rendered slightly soluble at their surface can be made soluble through destruction of the slightly soluble dissolution retarder shell, which is caused by reaction heat generated upon the reduction of silver halides with a reducing agent or reaction heat generated upon the reaction of the foregoing reaction products with the slightly soluble silver salt-forming compound which is adsorbed by the silver salt grains.

Preferred silver salt grains are those prepared from silver ions and chlorine ions, bromine ions, iodine ions, cyan ions, thiocyan ions, selecyan ions, sulfite ions, sulfate ions or a complex ion of two or more thereof. More preferably, they are silver halide grains more easily dissolved than light-sensitive silver halide grains when heat is applied thereto. Specifically, primitive (chemically unsensitized) pure silver chloride, pure silver bromide or silver chlorobromide emulsions, or mixed emulsions of two or more thereof, can be used. In such silver halide grains, a small amount (about 5 mole % or less) of iodide may be present. It is preferable that these silver salt grains should be smaller in grain size than the light-sensitive sensitive silver halide grains. In particular, a fine-grained pure silver chloride primitive emulsion is preferred over others. A suitable grain size for these silver salt gains ranges from about 0.01 μm to 2 μm, particularly preferably from about 0.05 μm to 0.5 μm. These silver salt grains are used in an amount of about 0.1 to 100 mole, preferably about 0.2 to 20 mole, and particularly preferably about 0.5 to 5 mole, per mole of light-sensitive silver halide.

The term "slightly soluble silver salt" in the present invention signifies a silver salt having a reduced solubility in water provided by adsorbing a dissolution retarder on the surface of the silver salt grains. These solubility in water are about $10^{-10}$ to $10^{-5}$ mol/l, preferably about $10^{-10}$to $10^{-6}$ mol/l, most preferably about $10^{-10}$ to $10^{-7}$ mol/l.

Suitable examples of such dissolution-retarding compounds, capable of forming such slightly soluble silver salt include compounds having a mercapto group and compounds having a heterocyclic ring containing a >NH group. Of these compounds, those containing a moiety represented by the following formula,

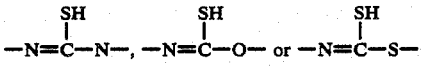

(including their tautomers) are preferred.

Such dissolution-retarding compounds capable of forming the slightly soluble salts are represented by the following formulae (I) and (II).

Formula (I)

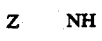

In formula (I), Z represents a non-metallic atom group which forms a heterocyclic ring containing an imino up together with a nitrogen atom.

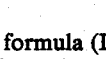

Formula (II)

In formula (II), M represents a hydrogen atom or an alkali metal atom and R represents a aliphatic hydrocarbon group or a heterocyclic group.

The present invention can preferably use the compound described below formulae (III) to (XI) among the cyclic imino compound described above formula (I).

Formula (III)

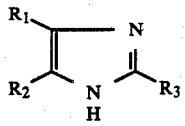

Formula (IV)

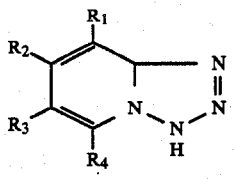

Formula (V)

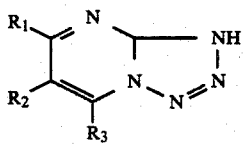

Formula (VI)

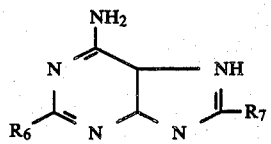

Formula (VII)

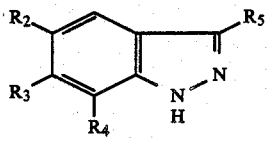

Formula (VIII)

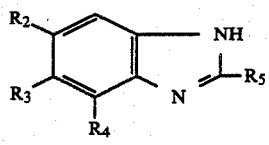

Formula (IX)

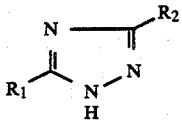

Formula (X)

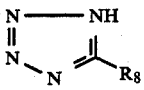

Formula (XI)

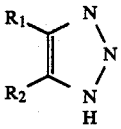

In the above formulae (III) to (XI), $R_1$, $R_2$, $R_3$ and $R_4$ each represents a hydrogen atom, an alkyl group, an aralkyl group, an alkenyl group, an alkoxy group, an aryl group, $-NR_9R_{10}$, $-COOR_{11}$, $-CONR_9R_{10}$, $-NHSO_2R_9$, $-SO_2NR_9R_{10}$, $-NO_2$, a halogen atom, —CN or —OH (wherein $R_9$ and $R_{10}$ each represents a hydrogen atom, and an alkyl group, an aryl group or an aralkyl group; $R_{11}$ represents an alkyl group, an aryl group or an aralkyl group; and M represents a hydrogen atom or an alkali metal atom).

Where $R_1$ and $R_2$ each represents an alkyl group, each of them may form an aliphatic hydrocarbon ring by combining $R_1$ with $R_2$. Furthermore, in the formula (XI), an aromatic hydrocarbon ring may be formed by combining $R_1$ with $R_2$.

$R_5$ represents a hydrogen atom, an alkyl group containing 1 to 5 carbon atoms or —S—$R_{12}$ (wherein $R_{12}$ represents a hydrogen atom, an alkyl group, an aryl group or an alkyl group).

$R_6$ represents a hydrogen atom or an alkyl group, and $R_7$ represents a hydrogen atom, an alkyl group or an aryl group.

$R_8$ represents an alkyl group, an aryl group, a benzyl group or a pyridyl group. The sum of the total carbon atom number of $R_1$ to $R_8$ is preferably not more than 12.

The present invention can preferably use the compound described below, formula (XII), among the mercapto compound described above, formula (II). Formula (XII)

Formula (XII)

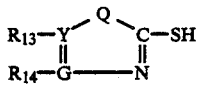

In the formula (XII), Q represents a oxygen atom, a sulfur atom or —$NR_{15}$ (wherein $R_{15}$ represents a hydrogen atom, an alkyl group, an unsaturated alkyl group or a substituted or unsubstituted aryl group or aralkyl group); Y and G each represents a carbon atom or a nitrogen atom, $R_{13}$ and $R_{14}$ each represents a hydrogen atom, an alkyl group, an unsaturated alkyl group, a substituted or unsubstituted aryl group or aralkyl group, —$SR_{16}$ or —$NH_2$ (wherein $R_{16}$ represents a hydrogen atom, an alkyl group, an aryl group, an aralkyl group, an alkylcarboxylic acid or the alkali metal salt thereof, or a sulfonic acid or the alkali metal salt thereof), where Y and G each represents a carbon atom, $R_{13}$ and $R_{14}$ may form a substituted or unsubstituted substituted aromatic carbon ring or a nitrogen containing heterocyclic ring.

Of the compounds of formula (XII), the compounds represented by following formulae (XIII) and (XIV) are particularly preferred.

Formula (XIII)

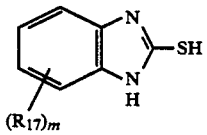

Formula (XIV)

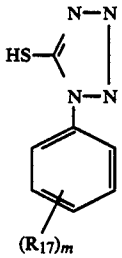

wherein m is an integer of 0 to 2, $R_{14}$ represents the same group as $R_1$. When m is 1 or 2, the total carbon atom number is preferably not more than 12.

Furthermore, the compounds represented by the following formula (XV) are preferred for the present invention.

$R_{18}$—S—$R_{19}$ Formula (XV)

wherein $R_{18}$ and $R_{19}$ each represents a substituted or unsubstituted aliphatic group, an aryl group or a heterocyclic group and $R_{18}$ and $R_{19}$ each may form a 5- to 7-membered ring together with S.

Specific examples of compounds represented by formula (III) to (XV) are described below, although the present invention is not to be construed as being limited thereto:

(1)

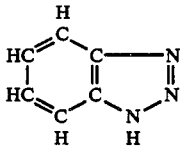

(2)

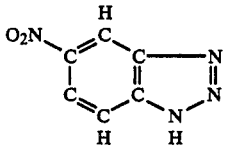

(3)

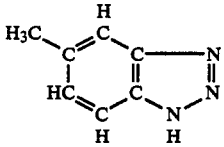

(4)

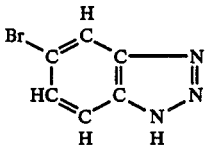

(5)

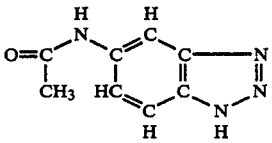

(6)

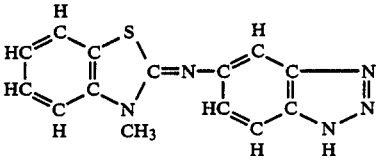

(7)

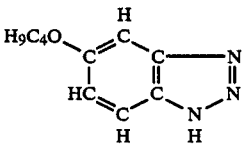

(8)

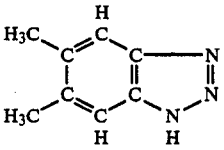

-continued
(9)
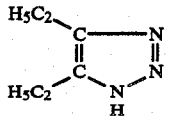
(10)
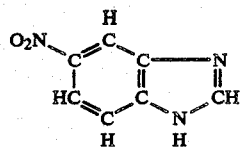
(11)
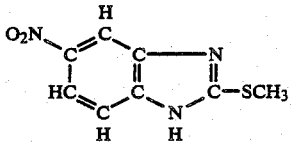
(12)
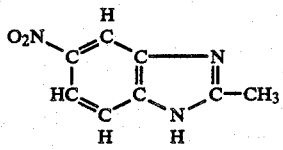
(13)
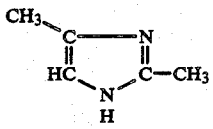
(14)
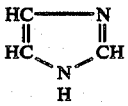
(15)
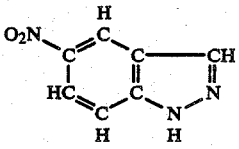
(16)
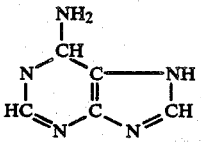
(17)
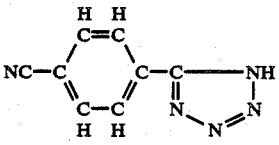
(18)
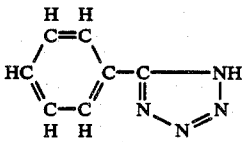
(19)
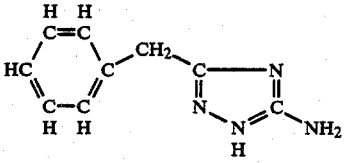
-continued
(20)
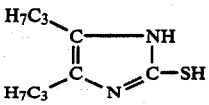
(21)
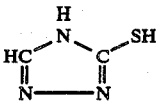
(22)
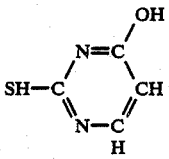
(23)
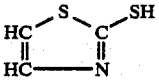
(24)
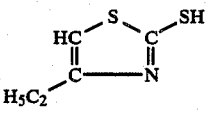
(25)
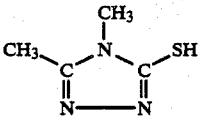
(26)
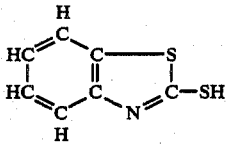
(27)
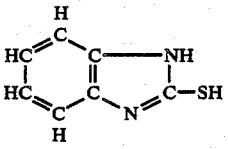
(28)
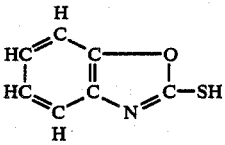
(29)
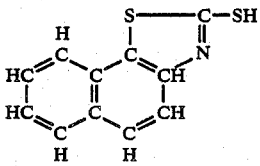
(30)
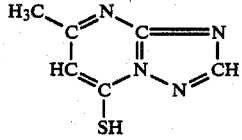

-continued
(31)
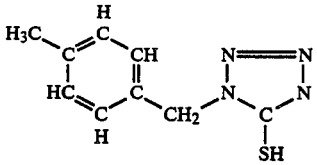
(32)
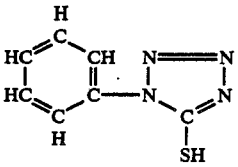
(33)
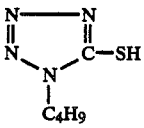
(34)
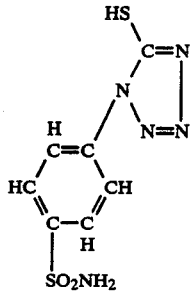
(35)
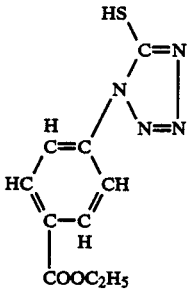
(36)
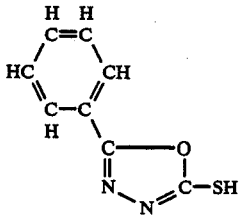
(37)
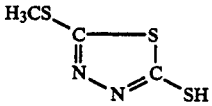
(38)
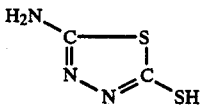
(39)
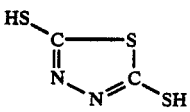
-continued
(40)
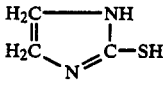
(41)
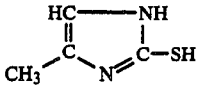
(42)
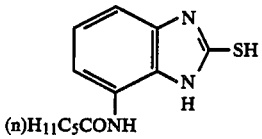
(43)
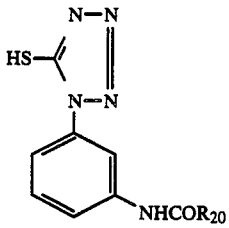
wherein $R_{20}$ represents
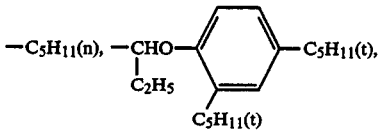
$-C_{11}H_{23}(n)$ or $-C_3H_7(iso)$
(44)
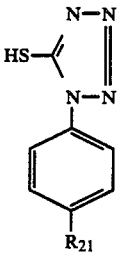
wherein $R_{21}$ represents
$-OCH_3$, $-OC_4H_9(n)$, $-OC_8H_{17}(n)$
$-OC_{12}H_{25}(n)$, $-OC_2H_5OCH_3$, $-OC_2H_5OC_2H_5$,
$-OC_2H_5OCH_2COOH$, $-SO_3Na$, $-Cl$, $-Br$ or $-NO_2$
(45)
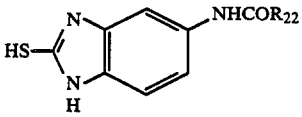
wherein $R_{22}$ represents
$-C_3H_7(iso)$, $-C_5H_{11}(n)$, $-C_{11}H_{23}(n)$,
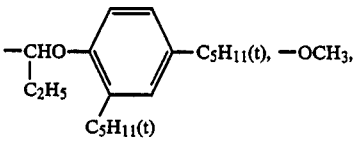
$-OC_8H_{17}(n)$ or $-OC_{12}H_{25}(n)$ -continued (46)

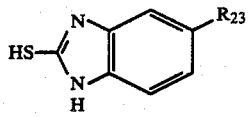

wherein $R_{23}$ represents $-SO_3Na$, $-NO_2$, $-Br$, $-Cl$, $-COOH$ or $-OC_2H_5OCH_2COOH$ The compounds as described above have typically been used as toning agents, development inhibitors, and/or antifoggants in conventional photogrpahy, and function to reduce the dissolving rates of silver salts through adsorption on the whole surface or at the dissolution active site of the silver salts.

Furthermore, specific examples of dissolution retarders which can be employed effectively in the present invention are set forth below, although the present invention is not to be construed as being limited thereto:

1-Phenyl-5-mercaptotetrazole,
2-Mercaptobenzothiazole,
2-Mercaptobenzimidazole,
1-(3-n-Amylacylaminophenyl)-5-mercaptotetrazole,
Sodium 1-Phenyl-1-H-tetrazole-5-thiol,
4-Ethyl-2-thio-oxazline,
2-Mercapto-5-furyl-1,3,4-oxadiazole,
1-Naphthyl-5-mercaptotetrazole,
2-Mercapto-4-methyl-pyrimidine Hydrochloride,
4-Hydroxy-2-mercapto-6-phenyl-pyridine,
4,4-dimethyl-2-thiothiazoline,
4-Hydroxy-2-mercapto-6-phenyl-pyrimidine,
2-Mercapto-1-methyl-imidazole,
2-Mercapto-5-methylmercapto-1,3,4-thiadiazole,
2,5-dimercapto-1,3,4-thiadiazole,
2,6-Dimercaptopurine,
Cysteine,
3-Mercapto-4-phenyl-5-methyl-1,2,4-triazole,
2-Mercapto-6-azauracil,
Benzylmercaptane,
Benzotriazole,
5-Butylimidazole,
8-Azaxanthyl,
6-Nitro-2-(2-oxacyclohexane)-benzimidazole Hydrochloride,
Thiourea,
2-Mercaptoethyl Sulfide,
5-Nitroindazole.

Suitable examples of light-sensitive silver halides which can be used in the present invention include silver iodide, silver bromide, silver chloride, silver iodobromide, silver chlorobromide, silver chloroiodobromide and mixtures of two or more thereof. A preferred silver halide is silver iodobromide having a high photographic speed. A particularly preferred silver halide is a silver iodobromide which has an iodide content of about 50 mole % or less.

In the present invention, a spectrally sensitized light-sensitive silver halide emulsion is preferably employed. Dyes which can be used for spectral sensitization include cyanine dyes, merocyanine dyes, complex cyanine dyes, complex merocyanine dyes, holopolar cyanine dyes, hemicyanine dyes, styryl dyes and hemioxonol dyes. Especially useful dyes are dyanine dyes, mercocyanine dyes and complex merocyanine dyes. Any nuclei conventonally used in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzoimidazole, quinoline and like nuclei. Each of these nuclei may be substituted at its carbon atoms.

The merocyanine and complex merocyanne dyes can contain 5- or 6-membered heterocyclic nuclei, such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

Specific examples of useful sensitizing dyes are illustrated below, although the present invention is not to be construed as being limited thereto:

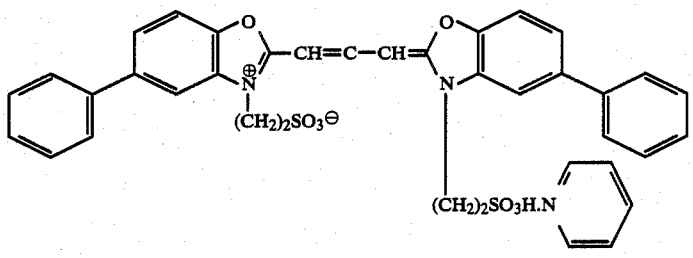

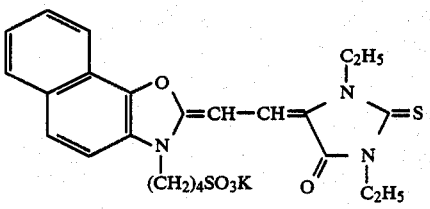

(wherein Et represents $C_2H_5$ hereinafter)

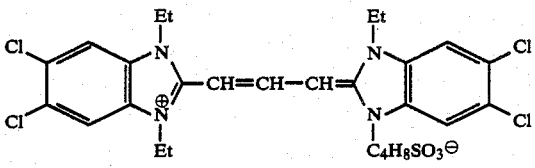

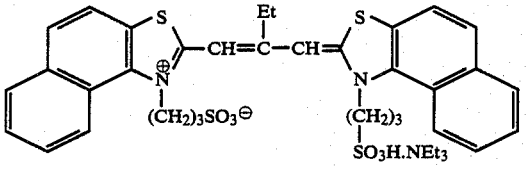

-continued

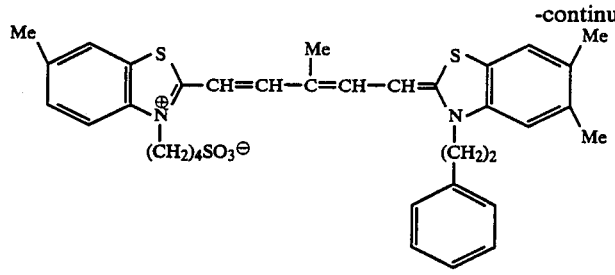

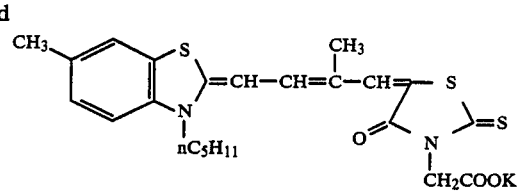

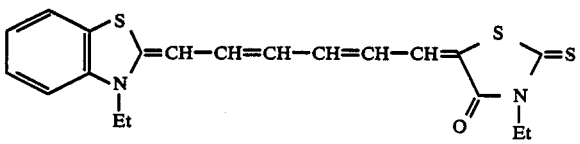

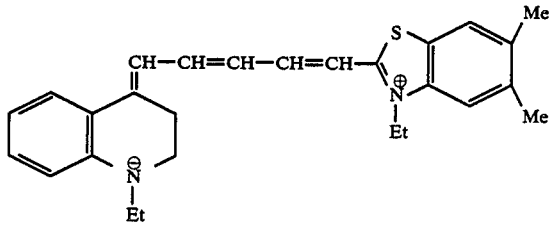

These sensitizing dyes may be employed individually or in combination. In particular, combinations of sensitizing dyes are often employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

Materials which can exhibit a supersensitizing effect in combination with a certain sensitizing dye, although they themselves do not spectrally sensitize silver halide emulsions or do not substantially absorb light in the visible region, may be incorporated in the emulsion. For example, aminostilbene compounds substituted with nitrogen-contaiing heterocyclic groups (such as those described in U.S. Pat. Nos. 2,933,390 and 3,635,721), aromatic organic acid-formaldehyde condensates (such as those described in U.S. Pat. No. 3,743,510), cadmium salts, azaindene compounds and so on can be used. Particularly useful combinations are described in U.S. Pat. Nos. 3,615,613, 3,615,641, 3,617,295 and 3,635,721.

In order to incorporate these sensitizing dyes into silver halide photographic emulsions, they may be dispersed directly into the emulsions, or added to the emulsions in the form of a solution prepared by dissolving the dyes in proper solvents, such as water, methanol, ethanol, acetone, methyl cellosolve, mixtures of two or more thereof, and the like. Moreover, they may be added to the emulsions as dispersions prepared by dissolving the dyes in solvents which are substantially immiscible with water, e.g., phenoxyethanol and the like, and then dispersing the resulting solutions into water or hydrophilic colloids. In addition, these sensitizing dyes can be added to silver halide emulsions together with oleophilic compounds such as dye-providing compounds as mixtures thereof. Sensitizing dyes used in combination can be dissolved separately in their respective proper solvents, or dissolved together as a mixture in the same solvent. Further, the dyes dissolved in separate solvents can be added simultaneously to a photographic emulsion as a mxiture, or independently as separate solutions. Furthermore, they may be added to a photographic emulsion simultaneously with other additives. The addition of these sensitizing dyes to photographic emulsions may be carried out during, before or after chemical ripening. Also, the dyes may be added before or after the nucleation of silver halide grains according to the procedures described in U.S. Pat. Nos. 4,183,756 and 4,225,666.

The amount of such sensitizing dyes described above present in the light-sensitive emulsion ranges generally from about $10^{-8}$ mole to $10^{-2}$ mole per 1 mole of silver halide.

In the present invention a thermal solvent is preferably incorporated in photographic emulsions. The term "thermal solvent" used herein signifies a nonhydrolytic organic material which is in a solid state at ordinary temperatures, which if heated to a heat treatment temperature used in development or below it can be fused together with another ingredient to show a mixed melting point. Compounds which are useful thermal solvents include solvents for developers, those having high permittivites known to accelerate the physical development of silver salts, and so on. Specific examples of useful thermal solvents include polyglycols described in U.S. Pat. No. 3,347,675, such as polyethylene glycol having a mean molecular weight of about 1,500 to 20,000 polyethylene oxide derivatives such as oleates of polyethylene oxide, beeswax, monostearin, and compounds containing —$SO_2$— group or —CO— group and having high permittivity, such as acetamide, succinimide, ethyl carbamate, urea, methylsulfonamide, ethylene carbonate, polar substances described in U.S. Pat. No. 3,667,959, lactone of 4-hydroxybutyric acid, methylsulfinylmethane, tetrahydrothiophene-1,1-dioxide, and 1,10-decanediol, methylanisate, biphenyl suberate and so on which are described in Research Disclosure, pp. 26–28 (December 1976).

In addition, dimethyl terephthalate and the like described in Japanese patent application (OPI) No. 83154/84, urea derivatives described in U.S. Pat. No. 4,433,037, and compounds described in Japanese patent application (OPI) Nos. 198038/83 and 68730/84 are also useful as thermal solvents.

Preferably in the present invention compounds capable of forming diffusible complex compounds by reacting with silver halides are incorporated in silver halide emulsion layers or other light-insensitive layers.

Specific exmaples of such compounds include thiosulfates such as sodium thiosulfate, potassium thiosulfate and ammonium thiosulfate, cyanides such as sodium cyanide and potassium cyanide, thiocyanates such as sodium thiocyanate, potassium thiocyanate and ammonium thiocyanate, sulfites such as sodium sulfite, thioureas such as thiourea, 1,3-dimethylthiourea and phenylthiourea, thioethers such as dodecyl hexyl thioether and 3,6-dithio-1,8-octanediol, imides such as uracil, phthalimide, malonimide and phthalazinone, nitrogen-containing heterocyclic compounds such as triazole, imidazole, piperazine and pyridine, primary, secondary or tertiary amines such as diethylamine, diethylenetriamine, 1-ethylenediamine, 1,2,3-triaminopropane, triethylenetetramine and ethylenediamine tetraacetate, amino acids such as alginine, histidine, cysteine and methionine, halides such as sodium fluoride, sodium chloride, sodium bromide and potassium chloride, alkalis such as sodium hydroxide and potassium hydroxide, and so on.

Besides using silver as an image-forming substance, the present invention can employ a wide variety of image-forming substances according to various methods as desired.

Such image-forming substances can include couplers which form color images by coupling with oxidants of developers used in the widely known liquid development processing. Suitable examples of magenta couplers includes 5-pyrazolone couplers, pyrazolobenzimidazole couplers, cyanoacetylcumarone couplers and open-chain acylacetonitrile couplers. Suitable examples of yellow couplers include acylacetamide couplers (e.g., benzoylacetoanilides and pivaloylacetoanilides). Suitable examples of cyan couplers include naphthol couplers and phenol couplers. Preferably these couplers should be rendered nondiffusible by a hydrophobic group functioning as a ballast group, or should be polymerized. These couplers may be either two-equivalent or four-equivalent to silver ion. Colored couplers having a color correction effect, or couplers capable of releasing a development inhibitor upon development (so-called DIR couplers) may be included.

Another example of image-forming substances is dyes that form positive dye images using a light-sensitive silver dye bleach process. Specific examples of such dyes include those described in *Research Disclosure,* pp. 30–32 (RD-14433)(Apr. 1976), *Research Disclosure,* pp. 14–15 (RD-15227)(Dec. 1976), and U.S. Pat. No. 4,235,957, and leuco dyes described in U.S. Pat. Nos. 3,985,565 and 4,022,617.

In addition, dyes into which nitrogen-containing heterocyclic groups are introduced, as described in *Research Disclosure,* pp. 54–58 (RD-16966)(May, 1978), can be employed as image-forming substance.

Further, dye-providing substances capable of releasing mobile dyes by a coupling reaction with reducing agents oxidized by the redox reaction with silver halides or organic silver salts under high temperatures, as described in European Pat. No. 79,056, German Pat. No. 3,217,853, and European Pat. No. 67,455, and dye-providing substances of the kind which undergo a redox reaction with silver halides or organic silver salts under high temperatures to release mobile dyes, as described in European Pat. No. 76,492, German Pat. No. 3,215,485, European Patent No. 66,282, and Japanese Patent Application (OPI) Nos. 154445/84 and 152440/84, can be employed.

Dye-providing substances which can be employed in the above-described methods are described in detail below.

Dye-providing substances which are useful in the present invention are represented by the following formula (I):

$$D\text{-}Y \qquad (I)$$

wherein D represents a dye moiety (including a dye precursor moiety), and Y represents a substrate having the function of changing the diffusibility of the dye-providing substance of formula (I) through a redox reaction caused in the heat development step.

The expression "changing the diffusibility" is intended to include two cases: (1) the compound (I) is nondiffusible by nature, and it is converted to a diffusible compound or releases a diffusible dye, and (2) an essentially diffusible compound (I) is changed into a nondiffusible form. Such changes in diffusibility result from either oxidation or reduction of Y. Which reaction Y undergoes depends on the nature of Y, and Y can be selected appropriately according to the reaction desired.

In the case where the diffusibility is changed by oxidation of Y, examples of Y include "dye-releasing redox" substrates such as p-sulfonamidonaphthols and p-sulfonamidophenols, examples of which are described in Japanese Patent Application (OPI) Nos. 33826/73 and 50736/78, and European Pat. No. 76,492; o-sulfonamidophenols and o-sulfonamidonaphthols, examples of which are described in Japanese patent application (OPI) Nos. 113624/76, 12642/81, 16130/81, 16131/81, 4043/82 and 650/82, U.S. Pat. No. 4,053,312, and European Patent No. 76,492; hydroxysulfonamidoheterocyclic compounds (as described in Japanese Patent Application (OPI) No. 104343/76, and European Pat. No. 76,492); and 3-sulfonamidoindoles (as described in Japanese Patent Application (OPI) Nos. 104343/76, 46730/78, 130122/79 and 85055/82, and European Pat. No. 76,492).

Other examples of Y in which the diffusibility is changed by oxidation of Y include intramolecular assist type substrates described in Japanese Patent Application (OPI) Nos. 20735/82 and 65839/84, which release dyes by an intramolecular nucleophilic attack after Y has been oxidized.

Additional examples of Y in which Y is oxidized include substrates which substantially lose dye-releasing capability when oxidized, although they can release dyes by an intramolecular ring-closure reaction under basic conditions, such as the substrates described in Japanese Patent Application (OPI) No. 63618/76. As a modification of such substrates, substrates which can release dyes when an iso-oxazolone ring changes its manner of bonding of a ring by the attack of a nucleophilic agent thereon are also useful. Specific examples of such modified substrates are described in Japanese Patent Application (OPI) Nos. 111628/74 and 4819/77.

Further examples of Y include substrates of the kind which lose substantially their dye-releasing ability by being oxidized though the dye moiety splits off by dissociation of an acidic proton under basic conditions, described in Japanese Patent Application (OPI) Nos. 69033/78 and 130927/79.

On the other hand, examples of Y in which the diffusibility is changed by reduction of Y, include nitro compounds described in Japanese Patent Application (OPI) No. 110827/78, and quinone compounds described in Japanese patent application (OPI) No. 110827/78, and U.S. Pat. Nos. 4,356,249 and 4,358,525. These substrates are reduced with a reducing agent (called an electron donor) that is not consumed in the heat development step. As the result of the reduction, the substrates produce nucleophilic groups, and release dyes by intramolecular attack of the resulting nucleophilic groups. As a modification of these substrates, those of quinone type, in which a dye moiety splits off through dissociation of an acidic proton of the reduction product, are also useful. (Specific examples of such modified substrates are described in Japanese Patent Application (OPI) Nos. 130927/79 and 164342/81). When substrates causing changes in diffusibility by reduction are employed, it is essential to use a proper reducing agent (electron donor) for mediation between a silver salt oxidizer and a dye-providing substance. Specific examples of suitable reducing agents for this purpose are described in the foregoing publications. In addition, substrates which contain an electron donor in their molecules ("LDA compounds") can be used to advantage.

Still other examples of image-forming materials include compounds having a dye moiety which change their mobilities as the result of a redox reaction with silver halides or organic silver salts under high temperatures, which are described in Japanese Patent Application (OPI) No. 165054/84, and materials capable of releasing mobile dyes by reaction with silver ions present in sensitive materials, such as those described in Japanese Patent Application (OPI) No. 180548/84.

Many of the above-described materials form an imagewise distribution of mobile dyes in sensitive materials in proportion to exposure to light. Methods for transferring these image dyes into a dye-fixing material (i.e., "diffusion transfer") are described in the above patent documents, Japanese Patent Application (OPI) Nos. 168439/84 and 182447/84.

The dye-providing substance used in the present invention can be introduced into a layer of the photosensitive material by known methods such as a method as described in U.S. Pat. No. 2,322,027. In this case, an organic solvent having a high boiling point or an organic solvent having a low boiling point as described below can be used. For example, the dye-providing substance is dispersed in a hydrophilic colloid after it is dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, sccondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye-providing substance is dispersed in a hydrophilic colloid. For this purpose, the surface active agents illustrated in other part of the specification can be used.

In the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which the particle size and/or a halogen composition are different from each other may be used in mixture.

An average particle size of the silver halide used in the present invention is preferably from 0.001 μm to 10 μm and more preferably from 0.001 μm to 5 um.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T.H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the photosensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a srvler salt of benzotriazole and a derivative thereof as described in Japanese Patent Publication Nos. 30270/69 and 18416/70, for example, a silver salt of benzotriazole, a sivler salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese patent application (OPI) Nos. 13224/74 and 17216/75.

A suitable coating amount of the photosensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Anothe example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylenebis (sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

In the present invention, it is particularly preferred to use various bases or base precursors as dye releasing assistants.

The bases or precursors thereof can be used in a photosensitive material and/or a dye fixing material. In the case of incorporating them in a photosensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

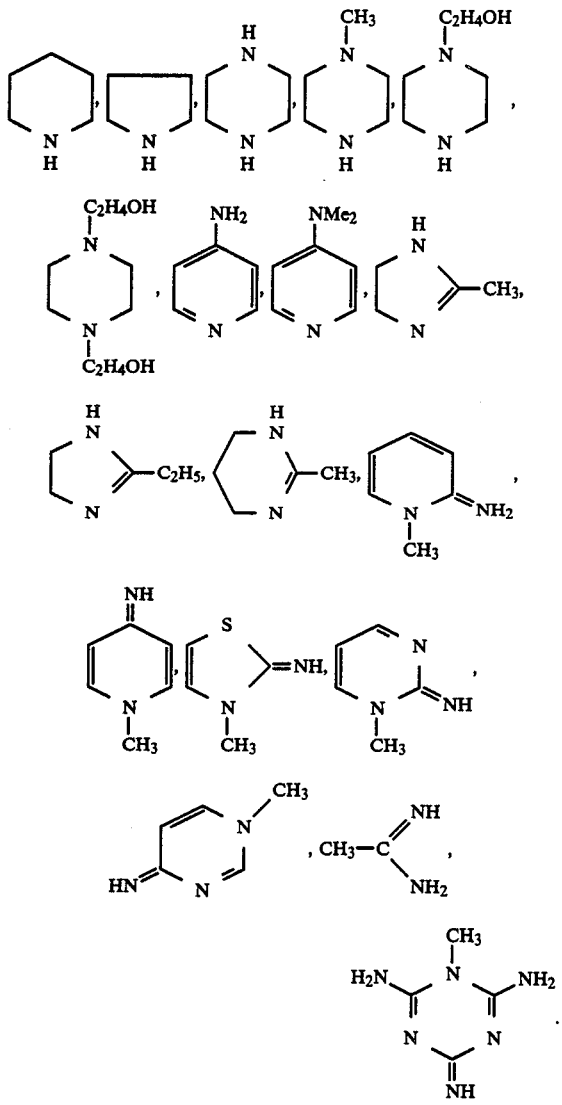

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure*, No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the photosensitive material, and, preferably a range of from 0.01% by weight to 40% by weight.

The above-described bases or base precursors can be used not only for the acceleration of dye release but also for other purposes such as the control of a pH value.

The above-described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat developable photosensitive material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxohol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the photosensitive material and the dye-fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the heat developable photosensitive material and the dye-fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

The transfer of dyes from the light-sensitive layer to the dye-fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the photosensitive material or the dye-fixing material, it is not necessary to supply the transfer assistant from the outside. In this case, the above described dye transfer assistant may be incorporated into the material in the form of water of crystallization or microcapsules or as a precursor which releases a solvent at a high temperature.

A more preferred process is a process wherein a hydrophilic thermal solvent which is solid at an ambient temperature and melts at a high temperature is incorporated into the photosensitive material or the dye-fixing material. The hydrophilic thermal solvent can be incorporated either into any of the photosensitive material and the dye-fixing material or into both of them. Although the solvent can be incorporated into any of the emulsion layer, the intermediate layer; the protective layer and the dye-fixing layer, it is preferred to incorporate it into the dye-fixing layer and/or adjacent layers thereto.

Examples of the hydrophilic thermal sovlents include ureas, pyridines, amides, sulfonamides, imides, alcohols, oximes and other heterocyclic compounds.

Other compounds which can be used in the photosensitive material of the present invention, for example, sulfamide derivatives, carionic compounds containing a pyridinium group, surface active agents having polyethylene oxide chains, sensitizing dye, antihalation and antiirradiation dyes, hardeners, mordants and so on, are those described in U.S. Pat. Nos. 4,500,626, 4,478,927, 4,463,079 and Japanese Patent Application No. 28928/83 (corresponding to U.S. patent application Ser. No. 582,655 filed on Feb. 23, 1984) and U.S. Pat. No. 4,503,137. Methods for the exposure and so on cited in the above-described patents can be employed in the present invention also.

The present invention is explained in greater detail by reference to the following examples, which, however, are not intended to be interpreted as limiting the scope of the present invention.

EXAMPLE 1

A silver iodobromide emulsion (A) was prepared in the following manner.

24 g of gelatin, 1 g of potassium bromide and 10 ml of 25% aqueous ammonia were dissolved in 1 liter of water (Solution II). This solution was maintained at 50° C., and stirred, while a solution containing 100 g of silver nitrate dissolved in 1 liter of water (Solution a) and a solution containing both 63 g of potassium bromide and 12 g of potassium iodide dissolved in 1 liter of water (Solution b) were added simultaneously over a period of 50 minutes, and excess salts were removed from the thus prepared emulsion. Thereafter, 70 g of water and 12 g of gelatin were added to the emulsion. Further, the emulsion was adjusted to pH 6.0, and subjected to gold sensitization and sulfur sensitization, to provide silver iodobromide emulsion (A) in a yield of 400 g.

Separately, a silver chloride emulsion (B) was prepared in the following manner.

40 g of gelatin and 12.5 g of sodium chloride was dissolved in 3,000 ml of water. The resulting solution was maintained at 50° C., and stirred, while a solution containing 34 g of silver nitrate dissovled in 200 ml of water was added all at once to the foregoing solution.

Thereafter, a solution containing 2 g of 1-phenyl-5-mercaptotetrazole as a dissolution retarder dissolved in 100 ml of thanol was added, and excess salts and 1-phenyl-5-mercaptotetrazole remaining unadsorbed were removed from the thus prepared emulsion.

Redispersion was carried out through pH adjustment using sodium carbonate. Thus, the emulsion of silver chloride on the surface of which 1-phenyl-5-mercaptotetrazole was adsorbed was obtained in a yield of 400 g.

Another silver chloride emulsion (C) was prepared in the following manner.

An emulsion (C) was prepared in the same manner as the above-described primitive silver chloride emulsion which adsorbed the foregoing dissolution retarder except that 1-phenyl-5-mercaptotetrazole was not added. The yield cf the emulsion obtained (C) was 400 g.

A coating composition A was prepared by adding the ingredients described below in the order listed, and this composition A was coated on a polyethylene terephthalate film support in a layer having a wet thickness of 60 μm, and dried.

| Coating Composition A | |
|---|---|
| Silver Iodobromide Emulsion (A) | 10 g |
| Silver Chloride Emulsion (B) | 10 g |
| 10% Aqueous Solution of Gelatin | 10 g |
| 5% Aqueous Solution of Hydroquinone | 15 ml |
| 5% Aqueous Solution of Following Compound AA | 5 ml |

Compound AA

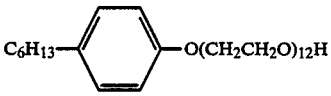

| | |
|---|---|
| 10% Aqueous Solution of Guanidinotrichloroacetic Acid | 1.3 ml |

On the thus formed emulsion layer, the following composition was further coated to form a protective layer. Thus, a photosensitive material 101 was obtained.

| Coating Composition for Protective Layer | |
|---|---|
| 10% Aqueous Solution of Gelatin | 30 g |
| 1% Aqueous Solution of 2-Ethylhexyl Sodium Sulfosuccinate | 10 ml |
| Water | 60 ml |
| 10% Aqueous Solution of Guanidinotrichloroacetic acid | 1.5 ml |

Another photosensitive material 102 was prepared in the same manner as the photosensitive material 101 except that silver chloride emulsion (C) was used in place of the silver chloride emulsion (B).

Immediately after the coating step, each of the photosensitive materials 101 and 102 was exposed to red light through a wedge filter, and heated uniformly for 10 seconds on a hot block kept at 140° C. Thus, a negative brown image was obtained.

Both maximum densities and minimum densities of these images are shown in Table 1.

TABLE 1

| Photosensitive Material | Maximum Density | Minimum Density |
|---|---|---|
| 101 (Invention) | 0.76 | 0.15 |
| 102 (Comparison) | 0.31 | 0.13 |

As can be seen from the results set forth in Table 1, the photosensitive material 101 of the present invention produced image of good quality, i.e., an image having high maximum density with negligible increase in fog density.

EXAMPLE 2

A silver chlorobromide emulsion (D) was prepared in the following manner.

800 ml of an aqueous solution in which 5 g of sodium chloride and 20 g of gelatin was dissolved was kept at 50° C. and thereto, a solution containing 50 g of silver nitrate dissolved in 400 ml of water and 400 ml of a solution in which both 19 g of potassium bromide and 8 g of sodium chloride were dissolved were added simultaneously at a rate of 20 ml/min.

Thereafter, unnecessary salts were removed from the thus prepared emulsion, and the resulting emulsion was adjusted to pH 6.3. Thereto, 5 ml of a 0.01% trimethylthiourea solution was added, and the emulsion was kept at 55° C. for 30 minutes to effect sulfur sensitization. The yield was 500 g.

A gelatin dispersion of a dye-providing substance was prepared in the following manner.

5 g of a cyan dye-providing substance having structural formula (21) illustrated below, 0.5 g of 2-ethylhexyl sodium sulfosuccinate, and 5 g of tricresyl phosphate (TCP) were weighed out respectively, and admixed with 30 ml of ethyl acetate. The mixture was heated up to about 60° C. and thereby, it was converted into a homogeneous solution. This solution was mixed with 100 g of a 10% lime-processed gelatin solution with stirring, and dispersed therein over a period of 10 minutes using a homogenizer rotating at 10,000 r.p.m., to obtain a dispersion of dye-providing substance (21).

Dye-providing Substance (21)

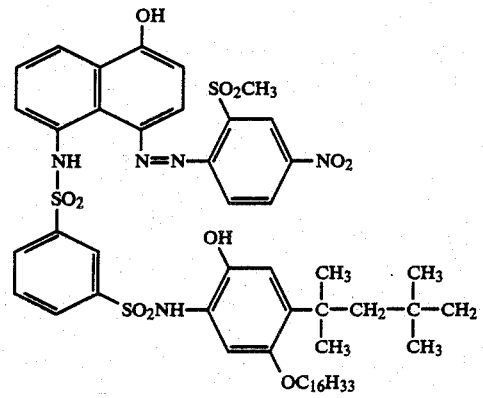

A photosensitive material 201 was prepared in the following manner.

| | |
|---|---|
| (a) Silver Chlorobromide Emulsion (D) | 10 g |
| (b) Silver Chloride Emulsion (C) | 10 g |
| (c) Dispersion of Dye-providing Substance (21) | 33 g |
| (d) 5% Water Solution of Compound AA | 5 ml |
| (e) 10% Ethanol Solution of Guanidinotrichloroacetic Acid | 12 ml |
| (f) 10% Water Solution of Compound BB | 4 ml |

$H_2N\text{-}SO_2\text{-}N(CH_3)_2$ Compound BB

A coating composition was prepared by mixing and dissolving ingredients (a) to (f) described above, and coated on a polyethylene terephthalate film support in a layer having a wet thickness of 30 μm, and dried. On the thus formed emulsion layer, a composition prepared by mixing ingredients (g)-(j) described below, i.e.,

| | |
|---|---|
| (g) 10% Water Solution of Lime-processed Gelatin | 35 g |
| (h) 10% Ethanol Solution of Guanidinotrichloroacetic Acid | 6 ml |
| (i) 1% Water Solution of 2-Ethylhexyl Sodium Sulfosuccinate | 4 ml |
| (j) Water | 55 ml |

was further coated to form a protective layer having a wet thickness of 25 μm, and dried. Thus, photosensitive material 201 was obtained.

A silver chloride emulsion (E) was prepared in the manner described below.

A 100 g portion of silver chloride emulsion (C) prepared in Example 1 was heated up to 60° C. and thereto, 150 mg of 1-phenyl-5-mercaptotetrazole was added. The mixture was stirred for 5 minutes, and cooled, to obtain silver chloride emulsion (E), which adsorbed the dissolution retarder.

Another photosensitive material 202 was prepared in the same manner as photosensitive material 201, except that instead of using silver chloride emulsion (C), silver chloride emulsion (E) was employed in the same amount.

Each of the photosensitive materials 201 and 202 was exposed to an imagewise pattern of light and then, heated uniformly for 35 seconds on a hot block kept at 140° C.

Further, a dye-fixing material R-1 was prepared in the manner described below.

In 200 ml of water was dissolved 10 g of poly-(methylacrylate-co-N,N,N-trimethyl-N-vinylbenzylammonium chloride) (co-polymerizing ratio of methylacrylate to the vinylbenzylammonium chloride was 1:1). The solution was mixed homogeneously with 100 g of 10% lime-processed gelatin solution. On a paper support laminated with polyethylene in which titanium oxide was dispersed, this mixture was coated uniformly in a layer having a wet thickness of 90 μm. After drying, the thus obtained material was used as a dye-fixing material having a mordanting layer.

After being dipped in water, the dye-fixing material R-1 was superposed on the sensitive material heated in the above-described procedure in such a way that the two materials were in a face-to-face contact. Thereafter, the superposed structure was heated on a hot block of 80° C. for 6 seconds and then, the dye-fixing material was peeled off the sensitive material. Thereupon, a negative cyan color image was obtained on the dye-fixing material. The sensitivity of this negative image to red light was measured using a Macbeth reflection densitometer (RD-519). The results obtained are shown in Table 2.

TABLE 2

| Photosensitive Material | Maximum Density | Minimum Density |
|---|---|---|
| 201 (Comparison) | 0.22 | 0.18 |
| 202 (Invention) | 1.89 | 0.28 |

As can be seen from the results of Table 2, the photosensitive material of the present invention produced an image of high maximum density and low minimum density, that is, an image of extremely good quality.

EXAMPLE 3

An emulsion containing a coupler CC having the structural formula illustrated below was prepared in the following manner.

To 100 g of a 10% water solution of gelatin, which had been dissolved at 40° C., 0.5 g of sodium dodecylbenzenesulfonate was added, and dissolved therein with stirring. Separately 10 g of the coupler CC, 5 g of tricresyl phosphate and 20 ml of ethyl acetate were mixed, and dissolved by heating to form a homogeneous solution. The gelatin solution containing the surface active agent and the solution containing the coupler CC were made into a emulsified dispersion using a homogenizer rotating at 12,000 r.p.m. for 3 minutes, to prepare a coupler dispersion.

Coupler CC

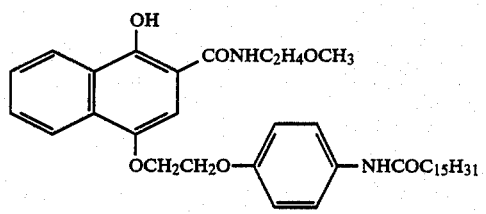

A photosensitive material 301 was prepared in the following manner.

| | | |
|---|---|---|
| (a) | Silver Iodobromide Emulsion (A) | 1 g |
| (b) | Silver Chloride Emulsion (B) prepared in Example 1 | 3 g |
| (c) | Emulsion containing Coupler CC | 1 g |
| (d) | 10 wt % Methanol Solution of 2,6-dichloro-p-aminophenol | 1 ml |
| (e) | 10 wt % Water Solution of Guanidinotrichloroacetic Acid | 1 ml |
| (f) | 5% Water Solution of Compound AA | 1 ml |

The above-described ingredients (a) to (f) were mixed and dissolved to make a solution. The solution was coated on a polyethylene terephthalate film in a layer having a wet thickness of 60 μm, and dried to prepare the photosensitive material 301.

Another photosensitive material 302 was prepared in the same manner as photosensitive material 301, except that instead of using the silver chloride emulsion (B), the silver chloride emulsion (C) prepared in Example 1 was employed in the same amount.

Each of the photosensitive materials 301 and 302 was exposed to light from a tungsten lamp through a wedge filter for 4 seconds at an illuminance of 20,000 lux. Thereafter, the materials were heated uniformly for 25 seconds on a hot block of 140° C.

After being dipped in a 0.1N aqueous solution of sodium hydroxide, the dye-fixing material R-1 prepared in Example 2 was superposed on each of the photosensitive materials 301 and 302, which had been heated in the above-described step, in such a way that the materials were in a face-to-face contact. After 30 seconds, the dye-fixing material was peeled off the photosensitive material. The density of negative cyan image formed on the dye-fixing material was measured with respect to red light using a Macbeth reflection densitometer (RD-519). The results obtained are shown in Table 3.

TABLE 3

| Photosensitive Material | Maximum Density | Minimum Density |
|---|---|---|
| 301 | 1.21 | 0.18 |
| 302 | 0.40 | 0.20 |

EXAMPLE 4

A photosensitive material (a negative sheet) 401 was prepared in the following manner.

| | | |
|---|---|---|
| (a) | Silver Chlorobromide Emulsion (D) | 10 g |
| (b) | Methanol containing 0.0002 g of Dye I | 7 ml |
| (c) | Silver Chloride Emulsion (E) | 20 g |
| (d) | 1% Water Solution of 2-Ethylhexyl Sodium Sulfosuccinate | 2 ml |
| (e) | 10% Methanol Solution of 1-Phenyl-3-pyrazolidone | 2 ml |

The above-described ingredients (a) to (e) were mixed in that order, and dissolved by heating. The thus prepared solution was coated on a 180 μm-thick polyethylene terephthalate film in a wet thickness of 80 μm.

On the thus formed emulsion layer, a composition prepared by mixing the following ingredients was further coated as a protective layer in a wet thickness of 40 μm, to obtain the photosensitive material (negative sheet) 401.

Coating Composition for Protective Layer

| | | |
|---|---|---|
| (a) | 10% Gelatin Aqueous Solution | 30 g |
| (b) | 1% Water Solution of 2-Ethylhexyl Sodium Sulfosuccinate | 10 ml |
| (c) | Water | 60 ml |

Dye I

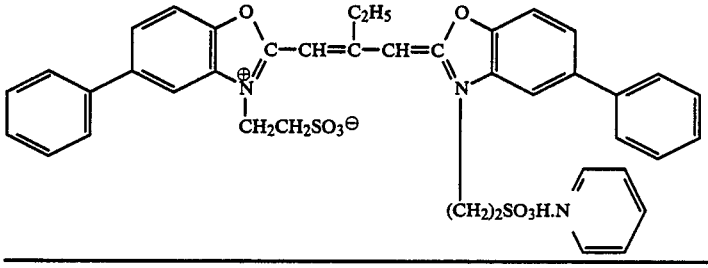

Another photosensitive material 402 was prepared in the same manner as the photosensitive material 401, except that instead of using the silver chloride emulsion (E), the silver chloride emulsion (C) was employed in the same amount.

In addition, a sivler salt-fixing sheet (positive sheet) P-1 was prepared in the following manner.

On a $TiO_2$-containing white polyethylene terephthalate film, the solution prepared by mixing the ingredients (a) to (i) described below and heating for dissolution was coated in a wet thickness of 60 μm, and dried. Thus, positive sheet P-1 was obtained.

| | | |
|---|---|---|
| (a) | 10% Aqueous Solution of Polyvinyl Alcohol (polymerization degree: 500) | 20 g |
| (b) | Urea | 3.2 g |
| (c) | N—Methylurea | 4.8 g |
| (d) | Water | 15 ml |
| (e) | Ethanol | 5 ml |
| (f) | Hydrosulfate (hypo) | 0.4 g |
| (g) | 1-Phenyl-3-pyrazolidone | 0.4 g |
| (h) | Colloidal Silver Sulfide Dispersion (containing 0.05 g of Silver Sulfide) | 5 g |
| (i) | 1% Water Solution of 2-Ethylhexyl Sodium Sulfosuccinate | 2 ml |

Each of the thus prepared photosensitive materials 401 and 402 was exposed to light emitted from a tungsten lamp through both a green filter and a stepwise wedge at an exposure time of 1 second and an illuminance of 2,000 lux. Thereafter, each exposed sensitive material was brought into face-to-face contact with the coated surface of the positive sheet P-1, passed between a pair of hot rollers heated to 130° C. and then, heated on a hot block of 130° C. for 60 seconds.

Immediately after heating, the positive sheet was peeled off the photosensitive material. Thereupon, a blackish brown negative image of good quality was formed on the positive sheet when the photosensitive material 401 was used together, whereas when the photosensitive material 402 for comparison was used, the whole surface of the positive sheet turned blackish brown, and only a faint positive image was observed thereon.

Thus the heat developable photosensitive material of the present invention could be used effectively in the silver salt diffusion transfer process also.

EXAMPLE 5

A dispersion of dye-providing substance (22), and a dispersion of dye-providing substance (23) were prepared in the same manner as the gelatin dispersion of the cyan dye-providing substance (21) in Example 2, except that 5 g of dye-providing substance (22) and 5 g of dye-providing substance (23) respectively were employed in place of the same amount of cyan dye-providing substance (21).

The structural formulae of the dye-providing substances used and that of the dye II to be used hereinafter are illustrated below.

| | | |
|---|---|---|
| (a) | Silver Iodobromide Emulsion (A) | 5 g |
| (b) | Silver Chloride Emulsion (B) (prepared in Example 1) | 10 g |
| (c) | Dispersion of Dye-providing Substance (23) | 33 g |
| (d) | 5 wt % Water Solution of a Compound having Following Structural Formula 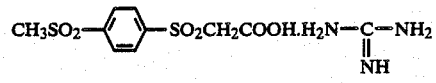 | 24 ml |
| (e) | 5 wt % Water Solution of a Compound having Following Structural Formula 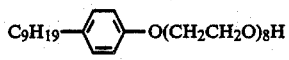 | 5 ml |
| (f) | 10 wt % Water Solution of Dimethylsulfamide | 4 ml |
| (g) | Water | 5 ml |

The above-described ingredients (a) to (g) were mixed in that order with stirring.

Further, a coating composition for forming a green-sensitive emulsion layer was prepared in the following manner.

| | | |
|---|---|---|
| (a) | Silver Iodobromide Emulsion (A) | 5 g |

Dye II

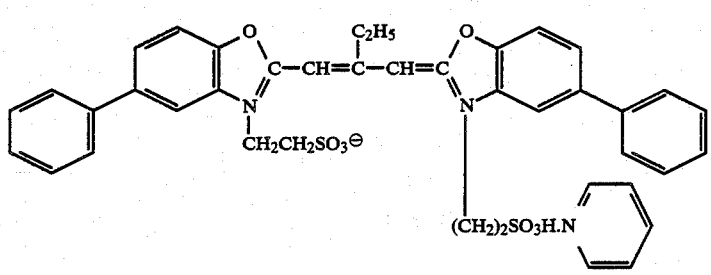

(22)

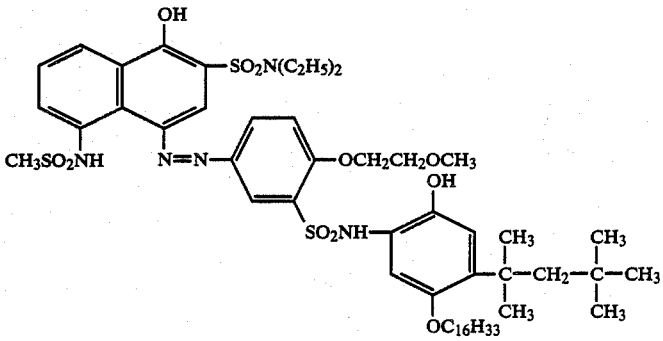

(23)

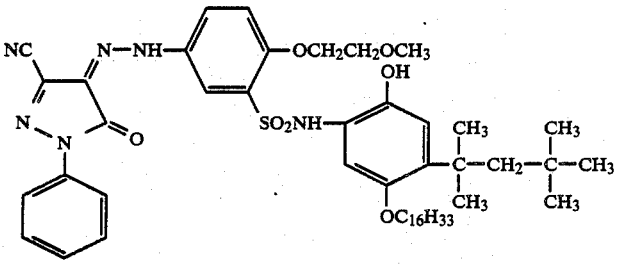

A coating composition for forming a blue-sensitive emulsion layer was prepared in the following manner.

| | | |
|---|---|---|
| (b) | 0.005 wt % Water Solution of Dye II | 4 ml |
| (c) | Silver Chloride Emulsion (B) | 10 g |

-continued

| | | |
|---|---|---|
| (d) | Dispersion of Dye-providing substance (22) | 33 g |
| (e) | 5 wt % Water Solution of a Compound having Following Structural Formula | 24 ml |

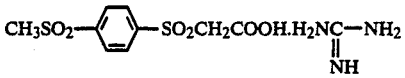

| | | |
|---|---|---|
| (f) | 5 wt % Water Solution of Compound having Following Structural Formula | 5 ml |

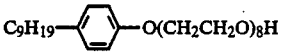

| | | |
|---|---|---|
| (g) | 10 wt % Water Solution of Dimethylsulfamide | 4 ml |
| (h) | Water | 5 ml |

The above-described ingredients (a) to (h) were mixed in that order with stirring.

A coating composition for forming a red-sensitive emulsion layer was prepared in the same manner as the coating composition for forming the green-sensitive emulsion layer, except that the silver chlorobromide emulsion (D) prepared in Example 2 was employed in place of the silver iodobromide emulsion (A), dye I was employed instead of dye II, and the gelatin dispersion of cyan dye-providing substance (21) used in Example 2 was employed in place of dye-providing substance (22).

The thus prepared coating compositions were coated on a support, with the red-sensitive layer, the interlayer, the green-sensitive layer, the interlayer, the blue-sensitive layer and the protective layer provided in that order from the support side. The coverage of silver halide in each sensitive layer was 400 mg/m$^2$ on a silver basis.

In the interlayer and the protective layer respectively, the gelatin coverage was 1,000 mg/m$^2$, and the coverage of the compound

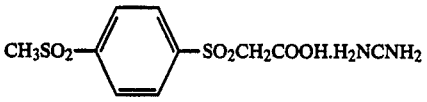

was adjusted to 190 mg/m$^2$.

One sample thus prepared was subjected to three color separation exposure (i.e., exposed to red light, green light and blue light, separately) through a wedge immediately after the coating procedure, while another identified sample was allowed to stand for 3 days under a temperature of 50° C. and then, subjected to the same three color separation exposure described above. Both samples were heated for 40 seconds on a hot block kept at 140° C. The transfer of image dyes into the dye-fixing material R-1 was carried out in the same manner as in Example 2. Thereupon, a negative three-color dye image of good quality was transferred onto the dye-fixing material.

The sensitivity of the material with respect to each color of the image obtained was measured. The results are summarized below.

| | Drop in sensitivity of material which has been kept at 50° C. for three days (log unit) |
|---|---|
| Blue-sensitive Layer | 0 |
| Green-sensitive Layer | −0.02 |

-continued

| | Drop in sensitivity of material which has been kept at 50° C. for three days (log unit) |
|---|---|
| Red-sensitive Layer | −0.04 |

As shown above, the heat developable type multicolor photosensitive material prepared in accordance with the present invention had excellent storage quality.

EXAMPLE 6

To a mixture containing 5 g of the dye-providing substance (25) having the structural formula illustrated below, 4 g of the electron donor having the structural formula illustrated below, 0.5 g of 2-ethylhexyl sodium sulfosuccinate and 10 g of tricresyl phosphate, were added 20 ml of cyclohexanone. The mixture was heated to about 60° C., and dissolved. Using this solution, a gelatin dispersion of a dye-providing subtance capable of being reduced was prepared in a similar manner as in Example 2.

Dye-providing Substance (25)

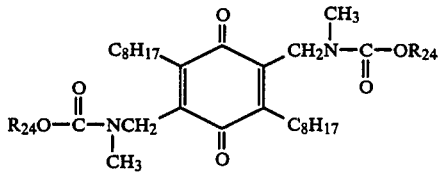

wherein $R_{24}$ represents

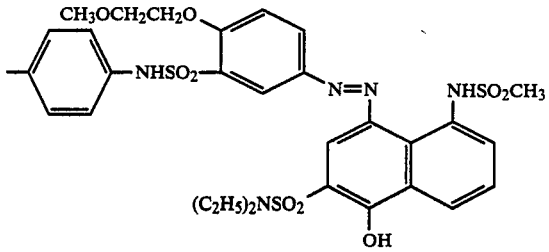

Electron Donor

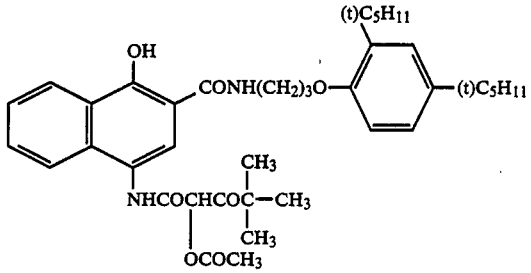

A photosensitive material 601 was prepared in the manner described below.

| | | |
|---|---|---|
| (a) | Silver Chlorobromide Emulsion (D) of Example 2 | 5 g |
| (b) | Silver Chloride Emulsion (E) of Example 2 | 10 g |
| (c) | Dispersion Dye-providing substance | 3.5 g |
| (d) | Solution containing 220 mg of Guanidinotrichloroacetic Acid dissolved in 5 ml of Ethanol | |

-continued

| | | |
|---|---|---|
| (e) | 5% Water solution of a Compound having the Formula 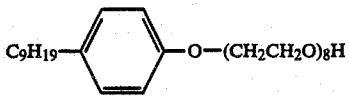 | 1.5 ml |

The above-described ingredients (a) to (e) were admixed with 2 ml of water, and dissolved by heating. The resulting solution was coated on a polyethylene terephthalate film in a wet thickness of 60 μm.

The thus obtained photosensitive material 601 was exposed to green light through a wedge, and heated uniformly for 30 seconds on a hot block kept at 130° C. Thereafter, dye transfer was carried out using the same dye-fixing material as in Example 2 in the same manner as in Example 2. Thereupon, a positive color image of good quality was obtained on the dye-fixing material.

EXAMPLE 7

A gelatin dispersion of a dye-providing substance was prepared in the following manner.

10 g of dye-providing substance (26) below, 0.5 g of 2-ethylhexyl sodium sulfosuccinate as a surface active agent, and 10 g of tricresyl phosphate (TCP) were weighed out and thereto, 20 ml of cyclohexane was added. The mixture was heated to about 60° C. and thereby, it was converted into a homogeneous solution. This solution was mixed with 100 g of a 10% aqueous lime-processed gelatin solution with stirring and then, dispersed using a homogenizer rotating at 10,000 r.p.m. for 10 minutes.

A photosensitive material 701 was prepared in the following manner.

| | | |
|---|---|---|
| (a) | Silver Iodobromide Emulsion (A) (Example 1) | 2 g |
| (b) | Silver Chloride Emulsion (E) (Example 2) | 5 g |
| (c) | 10% Water Solution of Gelatin | 2 g |
| (d) | Gelatin Dispersion of Dye-providing Substance (26) | 2.5 g |
| (e) | 10% Ethanol Solution of Guanidinotrichloroacetic Acid | 0.5 ml |
| (f) | 10% Methanol Solution of 2,6-Dichloro-4-aminophenol | 0.5 ml |
| (g) | 5% Water Solution of a Compound Having the Structural Formula 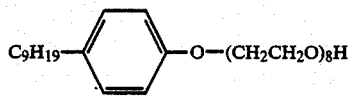 | 5 ml |
| (h) | Water | 4.5 ml |

The above-described ingredients were mixed, and dissolved by heating. The resulting solution was coated on a 180 μm-thick polyethylene terephthalate film in a wet thickness of 85 μm, to form an emulsion layer.

On the thus formed emulsion layer, a gelatin layer was further coated as a protective layer at a dry coverage of 1.5 g/m², to obtain photosensitive material 701.

Dye-providing substance (26)

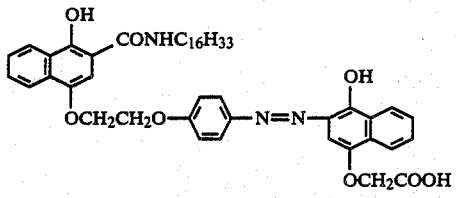

The sensitive material 701 was imagewise exposed for 10 seconds at an illuminance of 2,000 lux by means of a tungsten lamp. Thereafter, it was heated uniformly for 40 seconds on a hot block kept at 140° C.

Then, the transfer procedure was carried out using the same dye-fixing material as employed in Example 2 in the same manner as in Example 2, and a negative color image of good quality was transfered on the dye-fixing material.

EXAMPLE 8

A dye-fixing material R-2 was prepared in the manner described below.

A mixture of polyacrylic acid (polymerization degree: 2,000) and polyvinyl alcohol (mixing ratio: 1/1) was coated on a titanium oxide-coated polyethylene terephthalate film support at a coverage of 2 g/m². Thereon, a solution prepared by mixing homogeneously 100 g of a 10% water solution of poly(methylacrylate-co-N,N,N-trimethyl-N-vinylbenzylammonium chloride) (copolymerizing ratio of methylacrylate to the vinylbenzylammonium chloride was 1:1), 120 g of a 10% polyvinyl alcohol (saponification degree: 98%, polymerization degree: 2,000), 10 g of urea and 26 g of N-methylurea was further coated in a wet thickness of 70 μm, and dried. Thus, the dye-fixing material R-2 was obtained.

The photosensitive material 202 prepared in Example 2 was imagewise exposed for 10 seconds at an illuminance of 2,000 lux using a tungsten lamp. Thereafter, the material was uniformly heated for 30 seconds on a hot block kept at 140° C.

Then, the coated side of the dye-fixing material R-2 was brought into a face-to-face contact with the processed sensitive material, passed between a pair of hot rollers kept at 140° C., and further heated uniformly for 30 seconds on a hot block kept at 120° C.

On the dye-fixing material peeled off the sensitive material, a negative cyan color image of good quality was obtained.

While the invention has been described in detail and with reference to specific embodiments thereof, it will be apparent to one skilled in the art that various changes and modifications can be made therein without departing from the spirit and scope thereof.

What is claimed is:

1. A heat developable photosensitive material comprising a support, having a light-sensitive layer thereon wherein said light-sensitive layer comprises a light-sensitive silver halide, silver salt grains having a dissolution retarder absorbed thereto, a reducing agent, and a binder, wherein said dissolution retarder is selected from the group consisting of compounds having a mercapto group and compounds having a heterocyclic ring containing a NH group.

2. A heat developable photosensitive material as claimed in claim 1, wherein said silver salt grains have a sensivitity to light lower than the light-sensitivity of said light-sensitive silver halide by a factor of at least about 10.

3. A heat developable photosensitive material as claimed in claim 1, wherein said silver salt grains in the absence of said adsorbed dissolution retarder have a greater solubility in water than said light-sensitive silver halide.

4. A heat developable photosensitive material as claimed in claim 1, wherein said silver salt grains comprise a primitive emulsion of silver chloride, silver bromide or silver chlorobromide having a grain size from about 0.01 μm to 2 μm.

5. A heat developable photosensitive material as claimed in claim 4, wherein the grain size of said silver salt grains is from about 0.05 μm to 0.5 μm.

6. A heat developable photosensitive material as claimed in claim 1, wherein said silver salt is present in an amount of from about 0.1 to 100 mol per mol of said light-sensitive silver halide.

7. A heat developable photosensitive material as claimed in claim 6, wherein said silver salt grains are present in an amount of from about 0.5 to 5 mol per mol of said light-sensitive silver halide.

8. A heat developable photosensitive material as claimed in claim 1, wherein said dissolution retarder is selected from the group consisting of compounds containing a moiety selected from the group consisting of

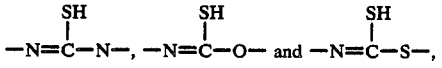

and tautomers thereof.

9. A heat developable photosensitive material as claimed in claim 1, wherein said light-sensitive silver halide is high-speed silver iodobromide having an iodide content of about 50 mol percent or less, said light-sensitive silver halide emulsion being spectrally sensitized.

10. A heat developable photosensitive material as claimed in claim 1, further comprising a thermal solvent.

11. A heat developable photosensitive material as claimed in claim 1, further comprising a compound capable of forming a diffusible complex compound by reaction with said silver halide during development.

* * * * *